United States Patent [19]

Sowder

[11] 3,951,073

[45] Apr. 20, 1976

[54] SELF CENTERING TENSION DRIVE TERMINAL FOR TRAMWAY

[76] Inventor: Tony R. Sowder, E. 814 Grace, Spokane, Wash. 99205

[22] Filed: Dec. 4, 1974

[21] Appl. No.: 529,387

[52] U.S. Cl. ..... 104/117; 104/196

[51] Int. Cl.[2] ..... B61B 12/00; E01B 25/18

[58] Field of Search ..... 104/89, 112, 114–117, 104/165, 172 R, 172 S, 173 R, 173 ST, 178, 196, 197; 254/172, 173 R, 175.3, 178; 242/129.4, 147 R, 155 BW

[56] References Cited

UNITED STATES PATENTS

| | | | |
|---|---|---|---|
| 397,611 | 2/1889 | Phenix | 104/196 |
| 1,109,371 | 9/1914 | Thunhart | 104/178 X |
| 3,071,083 | 1/1963 | Hochmuth | 104/178 |
| 3,202,110 | 8/1965 | Sowder | 104/196 |
| 3,728,972 | 4/1973 | Goforth et al. | 254/178 X |

FOREIGN PATENTS OR APPLICATIONS

| | | | |
|---|---|---|---|
| 175,285 | 6/1953 | Austria | 104/117 |

*Primary Examiner*—John J. Love
*Assistant Examiner*—Andres Kashnikow

[57] ABSTRACT

A drive terminal, for a continuous aerial cable tram system, movable on rails to tension the aerial cable. The drive terminal is biased to tensioning position by a suspended weight coupled to the terminal by a particular compensating linkage that eliminates torque forces between the drive terminal and its support.

3 Claims, 3 Drawing Figures

SELF CENTERING TENSION DRIVE TERMINAL FOR TRAMWAY

BACKGROUND OF INVENTION

RELATED APPLICATIONS

There are no other patent applications related hereto.

1. FIELD OF INVENTION

This invention relates generally to tensioning of movable drive terminals of transiting cable aerial trams and more particularly to a tensioning system that eliminates torque forces between the drive terminal and its support.

2. DESCRIPTION OF THE PRIOR ART

Tramways of the endless transiting aerial cable type are commonly driven by a bull-wheel carried on a driving station that is movably mounted so that tension in the transiting aerial cable may be regulated by appropriate positioning of the driving station, particularly as biased by a counterweight.

The conventional method heretofore known of mounting such driving stations has been to provide a carriage, supporting a driving bull-wheel and ancillary mechanical structure, which in turn is movably supported by plural wheels upon tracks ultimately supported by the earth. Generally the supportative tracks extend lineally in a direction substantially parallel to the course of cable travel, in the vicinity of the drive station, so that the driving terminal might move away from the cable course to efficiently create and maintain appropriate tension in the cable. Normally the carriage is biased by a gravity influenced weight to maintain appropriate cable tension under various ambient conditions of cable elasticity, temperature, load and the like.

The biasing of the driving station in this fashion, and more particularly the type of linkage between the driving station and the biasing weight, has in the prior art been such that there exists a torque or couple force acting between the driving station and its support. This force requires that the rail supporting the driving station be mounted so as to withstand this force and also requires that the support of the driving station upon the rails be such as to accommodate it. Both of these conditions require particular structural elements that are relatively expensive, tend to limit design capabilities and tend to increase maintenance and the possibilities of failures.

The instant invention alleviates these problems by providing a particular cable-type compensating linkage between the movable driving station and its biasing weight that eliminates any torque forces between the support structure and the driving station. To do this, I link the biasing weight by two fixed length cables to the driving station, both cables at one end being fastened to the same point on the weight and each at the other end is fastened at one of two laterally opposed points on the driving station with appropriate supportative sheaves in between. This linkage, as hereinafter more fully illustrated, eliminates any torque or skewing forces of the driving station relative to its supportative rails.

SUMMARY OF INVENTION

My invention provides an improved torque eliminating tensioning system for use with aerial tramways and mechanically similar devices having a torque generating element of some sort movably mounted for biased motion to tension a supported mechanical element such as a transiting cable or belt.

My invention provides a weight of appropriate mass, located as required by the particular design, and so positioned as to bias the driving station away from the course of cable transit. The biasing weight is linked to the driving station by two cables, one end of each linking cable being fastened to the biasing weight at the same point so that there is no torque acting on the driving station when in a null or non-biasing position. The other ends of the linking cables are fastened to the driving station at opposed points on opposite sides of its center. Plural sheaves, supported ultimately by the earth and not by the driving station are provided at appropriate positions to support the linking cables and allow both vertical gravity biased motion of the weight and lineal motion of the tensioning station along its supporting rails.

In providing such a structure it is:

A principal object of my invention to provide a weight biased tensioning system for an aerial tram having a movable driving station to eliminate torque or couple forces between the driving station and its support.

A further object of my invention to provide such a structure that has a cable-type linkage between movable driving station and biasing weight to automatically act to fulfill its purpose under ambient conditions of tram operation.

A still further object of my invention to provide such a structure that is of new and novel design, of rugged and durable nature, of simple and economic manufacture and one otherwise well adapted to the uses and purposes for which it is intended.

Other and further objects of my invention will appear from the following specification and accompanying drawings which form a part of this application. In carrying out the objects of my invention, however, it is to be remembered that its accidental features are susceptible to change in design and structural arrangement with only one preferred and practical embodiment being illustrated in the accompanying drawings as is required.

BRIEF DESCRIPTION OF DRAWINGS

In the accompanying drawings which form a part of this specification and wherein like numbers of reference refer to similar parts throughout.

DESCRIPTION OF PREFERRED EMBODIMENT

Figure 1:
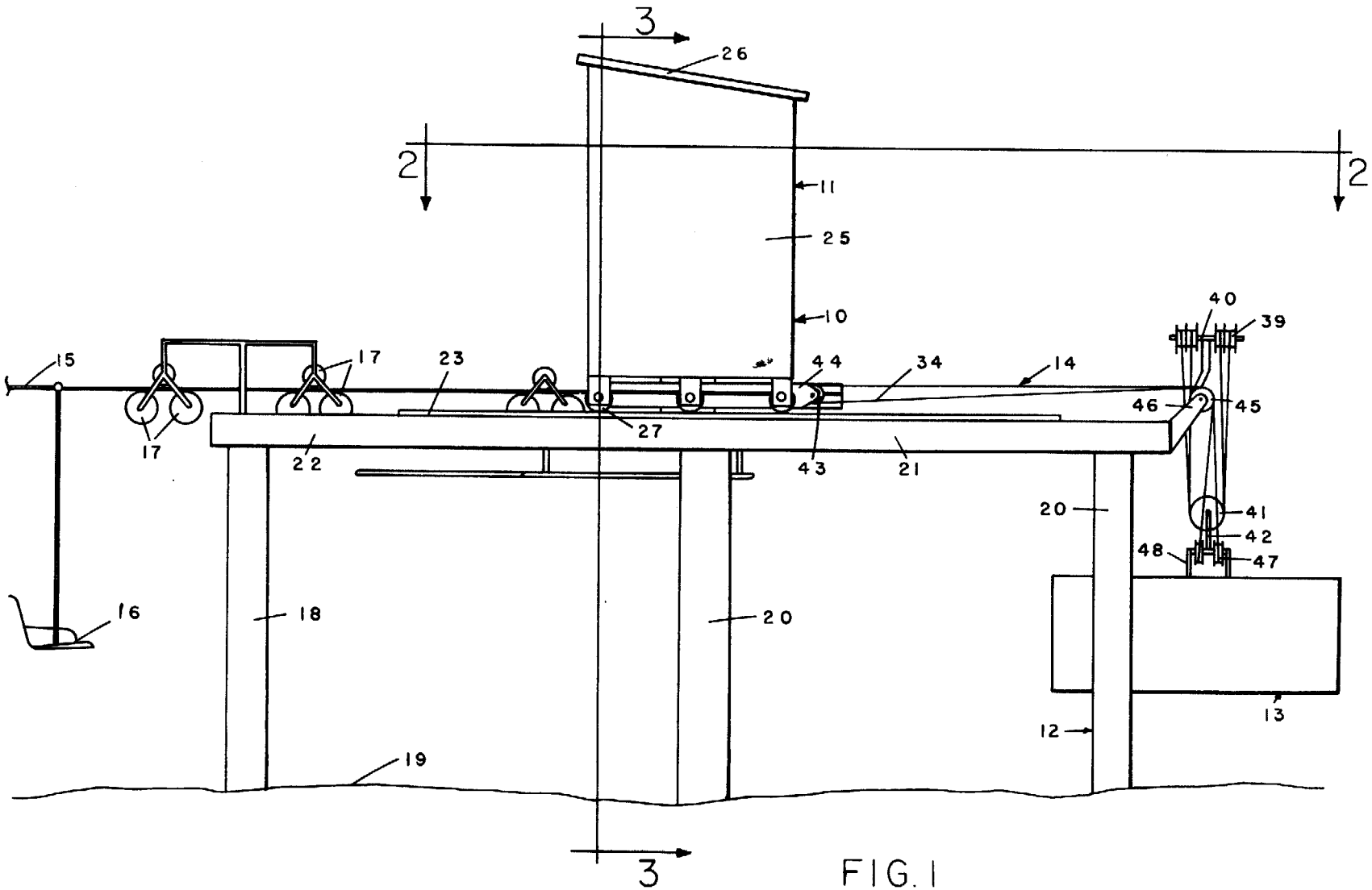
FIG. 1 is a partial orthographic side view of the end structure of a continuous cable aerial tram, showing particularly the movable driving station with my tensioning structure in use therewith.
Figure 3:
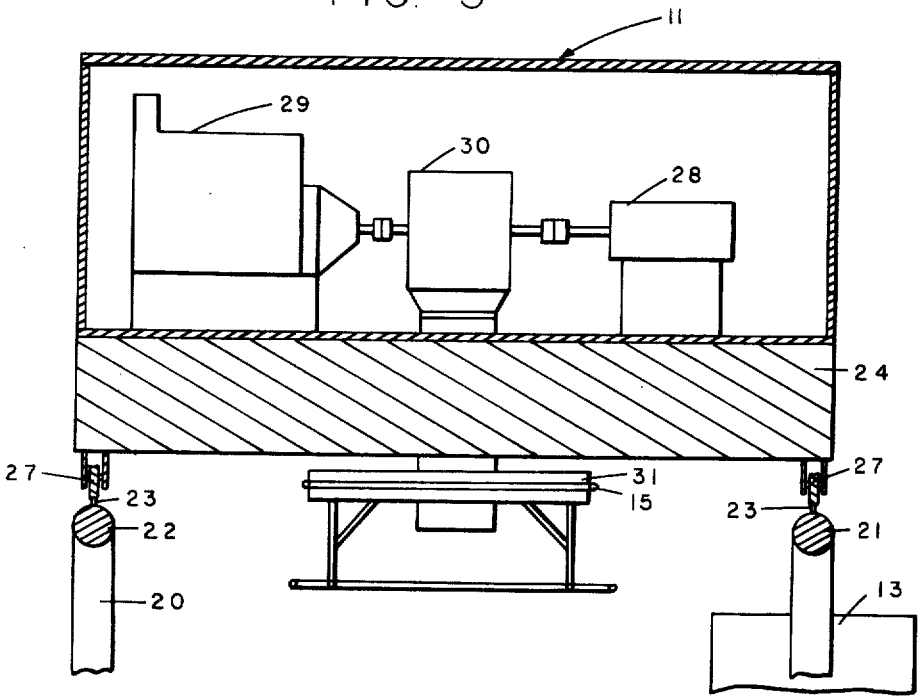
FIG. 3 is a vertical cross-sectional view of the structure of FIG. 1 taken on the line 3—3 thereon in the direction indicated by the arrows.

Referring now to the drawings in more detail and particularly to that of FIG. 1, there is seen the end of terminal portion of aerial tram structure 10, including movable driving terminal 11 carried by support structure 12 and biased to tensioning position by weight 13 communicating therewith by weight linkage 14.

Aerial tram structure 10 provides transiting endless cable 15 supporting plural spaced carriers 16 and in turn movably supported at a spaced distance above the earth by plural sheaves 17 carried by support towers 18 spaced throughout the course of travel. This essential structure is well known in the art and common to transiting cable aerial trams. Because of the extensive common knowledge of the structure, only its end or driving portion is illustrated in FIG. 1 as only that part of the structure is relevant to the instant invention.

The particular driving terminal support structure 12 illustrated in FIG. 1 provides for terminal support at a spaced distance above the surface 19 of the earth with a driving bull-wheel at a vertical elevation below that of the terminal's supporting rails. The support structure is formed with at least a framework of vertical posts 20 and structurally communicating horizontal beams 21 of dimension and rigidity appropriate to give the support required of the structure. Paired, spaced elongate rail support beams 22, normally comprising the lateral periphery of the structure, are positioned with their forward parts substantially vertically above the end of the transiting cable course and their elongate axis substantially parallel to the cable course immediately forward (toward the traction cable) of the structure. The vertical elevation of the rail support beams in the instance illustrated is slightly below the elevation of the traction cable. Spaced parallel cooperating rails 23 are carried on the upper surface of each rail support beam to cooperatively provide a track upon which the driving terminal might move in a lineal direction toward and away from the course of the traction cable. Obviously from the mechanical exigencies of tram operation, the vertical supports of driving terminal support structure 12 must be positioned so as not to interfere with the motion of the tram carriers nor access thereto and therefrom. In similar fashion the structure must be designed with appropriate strength and rigidity to carry the fairly substantial loads impressed upon it. These problems, however, are of a design engineering nature and their solutions have heretofore been well resolved in the prior art.

Driving terminal 11 provides supportative frame 24 with peripheral protective covering 25 and roof 26. The terminal need be of no particular configuration but generally is rectilinear and must be of sufficient width to be supported upon rails 23 of support structure 12 and of sufficient strength to support carried driving structure. For this purpose the supportative frame rotatably mounts plural wheels 27, normally three on each side positioned at appropriate distance to rollably support the structure on rails 23. The periphery of wheels 27 is adapted to fit the configuration of rails 23 to conformably roll thereover.

The driving terminal carries normal tram driving mechanism including primary motor 28 and stand-by motor 29 powering reducing transmission 30 which in turn powers depending, vertically journaled bull-wheel 31 which frictionally communicates with endless transiting traction cable 15 to tension and move that cable about its course. This driving terminal mechanism, again, is well known in the prior art and used in its essentials, at least, in most known endless-cable type aerial trams.

It is to be noted that in the structure shown, the driving terminal is carried on a support structure at a spaced distance above the earth and drives the traction cable by means of a depending bull-wheel. My invention, however, is equally applicable to a terminal structure, that is supported on rails ultimately supported on the earth, below a traction cable with driving structure extending upwardly from the terminal to operative communication with the cable. Both types of driving terminals are known in the art and my invention, with appropriate design, is equally applicable to either.

Biasing weight 13 is a structure of some appropriate substantial mass positioned rearwardly (away from the traction cable) of the driving terminal in a place where it is free to move vertically in response to traction cable length change to maintain a constant tensioning force upon the traction cable. Since the mass of the biasing weight must be substantial and its matter preferably rigidly coherent, it normally is formed from some reasonably dense material of relatively low cost such as concrete. The required weight of the biasing mass may be readily determined by application of well known engineering principles.

Biasing weight linkage system 14, wherein my invention primarily resides, connects biasing weight 13 with driving terminal 11. This linkage provides first cable 33 communicating from one rearward lateral part of the driving terminal over plural supportative sheaves to biasing weight 13 with second cable 34 communicating from the other rearward lateral part of the driving terminal over appropriate sheaves to the same point on the biasing weight. This linkage may be accomplished by single or multiple cables as the particular design instance might require, so long as the points of communication of the cables with the terminal are on appropriate sides of its media plane (with reference to its points of support).

Figure 2:
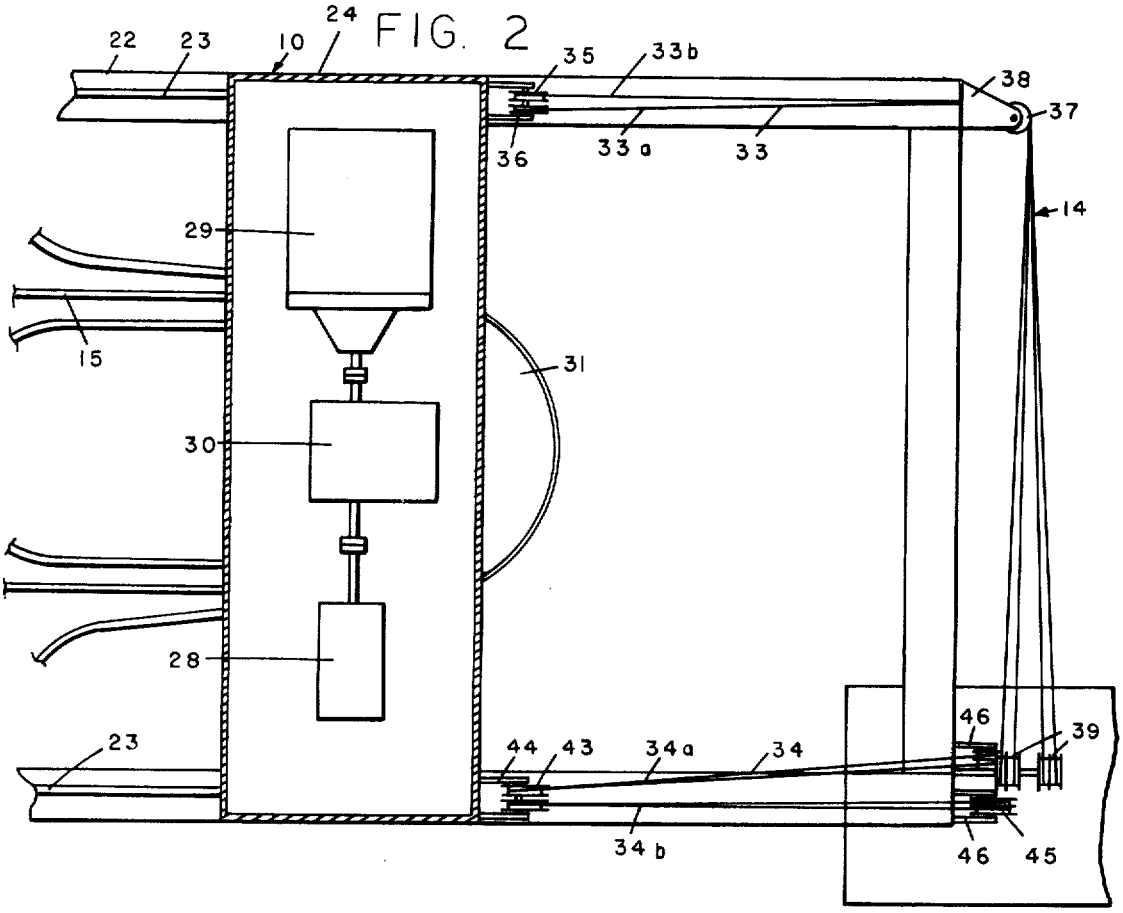
FIG. 2 is a vertical orthographic or plan view of a portion of the structure illustrated in FIG. 1 taken on the line 2—2 thereon in the direction indicated by the arrows.

In the instance illustrated in the accompanying drawings, and particularly FIGS. 1 and 2 thereof, the cables are of a double strand type. First cables 33*a*, 33*b* communicate from double sheaves 35 journaled on yoke 36 structurally carried by the laterally rearward driving terminal frame along driving terminal rails 23 to pass over double sheaves 37 journaled on a vertical axis in yoke 38 carried by driving terminal support 12 to thence pass over double sheaves 39 journaled on the horizontal axle of yoke 40 again supported on the driving terminal support to thence pass vertically downward and over double sheaves 41 supported about a horizontal axis of yoke 42 on biasing weight 13. Each cable thence returns via the same route to be carried by the cooperating member of each pair of double sheaves to communicate with its other end to form a closed cable system. Second cables 34*a*, 34*b* communicate from double sheaves 43 horizontally journaled by yoke 44 carried by the other or opposite laterally rearward portion of the driving terminal to pass over double sheaves 45 journaled about the horizontal axis of yoke 46 supported on the driving terminal support structure to thence pass vertically downward over double sheaves 47 horizontally journaled on yoke 48 carried by biasing weight 13 substantially at the same point as communication with sheaves 41. The second cable thence pass around sheaves 47 and return via the same route to form endless loops.

This double cable structure illustrated has been found most practical in use though a plural cable linkage is not necessary to the invention and the same function might be equally well accomplished with single cable linkage of the same type. The only essential feature of the linkage is that one cable communicate to each lateral portion of the driving terminal and pass thence rearward for some discrete distance substantially parallel with the direction of terminal motion to ultimately communicate over appropriate supporting sheaves with the gravity biased weight 13 at or substantially at the same point. Any other of a plurality of cable linkage which would accomplish this same essence would be within the ambit and scope of my invention.

The length of each cable loop must be so adjusted that when the driving station is in a null condition, that is when it is applying no driving torque, the tensioning cables also create no torque in it. If the tensioning cable attachment to the driving station be laterally symmetrical relative to the driving station support the tension in each will be equal but if their points attachment on the driving station be unsymmetrical the tension in each will be different so that the moments created on the driving station by each cable will be equal and opposite in direction. This cable adjustment may be accomplished by many of the known cable fastening means, and normally when once established it need not be changed.

With this description of the structure of my invention, its operation may now be more readily understood.

In aerial trams of the type described a certain tension must be maintained on the transiting traction cable to provide appropriate cable operation and positioning and external force must be applied to the cable to cause its transit. At the same time ambient conditions such as load, cable elasticity, termperature and the like effect the length of the cable, but notwithstanding the total cable length it is desirable that cable tension should remain reasonably constant. Such a constant tensioning is normally accomplished with a movable combination driving-tensioning system as described and illustrated. The movable tensioning-drive station, per se, is well known and quite common in the aerial tram arts. Normally heretofore such driving-tensioning terminal 11 has been biased to a tensioning position by a gravity activated mass or weight, connected at, or effectively at, a single point on the driving-tensioning terminal. With such structure when torque is imparted by the driving mechanism carried by the terminal there is a reactionary torque or couple created between the driving terminal and its supporting structure. Heretofore this couple has been accepted and appropriate mechanical measures taken in the linkage between the terminal and supporting rails to counteract it.

My invention, as illustrated, eliminates this couple and thusly prevents driving terminal 11 from skewing or tending to skew relative to its supporting rails 23. The result can be best seen in FIG. 2. Here, let it be assumed that there is an added force upon one of the cables 33, 34, as would be the case if there were any reactionary torque upon the driving terminal 11. If it be assumed that the tension in cable 33 be increased, as it would be, if the bull-wheel were rotating clockwise in the plan view, the reaction of biasing weight 13 increases the tension in the cable 33 differentially to counteract this torque and thus remove any couple between terminal and rails to reduce the system to a null state. The total biasing force on the driving terminal will be the sum of tensioning forces in the cables 33 and 34 and this total will remain constant, by reason the linkages between driving-tensioning station and biasing weight, the tension in cable 33 will not necessarily equal that in cable 34. This inequality of tension will be automatically created by reason of the connecting linkage to counteract any torquing forces in the driving terminal.

It is to be noted that cables 33, 34 might be connected to the driving terminal at any lateral distance from its center (as determined relative its support). The particular distance will create a variable lever arm through which the biasing weight may act, and may be determined in any particular situation to create couple eliminating forces of the desired magnitude.

It should be further noted that although the illustrated specific embodiment of my invention shows a biasing weight linkage comprising cables, other tension transmitting linkage such as plural articulating rods, chains or the like might serve the purpose of my invention, if not so well. Similarly, the biasing linkage might be used in applications other than trams to bias movable mechanical support or powering elements acted upon by couple forces, such as conveyor or belt rollers and non-symmetrical drive linkages, to eliminate couple reaction between such elements and their supports.

The foregoing description of my invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described my invention what I desire to protect by letters Patent and,

What I claim is:

1. A means of biasing a mechanical element, subject to torque forces, lineally movable along a support for a limited distance and biased toward one end of that support, to eliminate any reactive couple between the mechanical element and its support, comprising, in combination:

a biasing weight, positioned for potential movement responsive to gravity, communicating with the mechanical element by biasing weight linkage comprising two elongate tensile elements, each tensile element communicating by one end with the mechanical element at one of two laterally spaced points, one point being on each side of a vertical plane midway between the mechanical elements supports, each tensile element extending away from the mechanical element, substantially parallel to its line of motion for some discrete distance to communicate with the biasing weight at the same point, and each tensile element being of such length that the moments caused in the mechanical element by the biasing weight linkage are equal.

2. The invention of claim 1 wherein the elongate tensile elements comprise flexible cables supported upon plural sheaves along their courses.

3. In an aerial tram of the type having an endless transiting traction cable supporting plural carriers and in turn being supported at a spaced distance above the earth upon plural sheaves carried by plural spaced support towers with a driving terminal, carrying driving mechanism, movably supported on a driving terminal support for lineal motion toward and away from the traction cable course, a biasing system to regulate traction cable tension comprising, in combination:

a biasing weight, positioned for vertical gravity activated motion, mechanically communicating with a driving terminal by biasing weight linkage comprising two cables, each communicating by one end with the driving terminal at one of two laterally spaced points, one point being on each side of a vertical plane midway between and parallel with the lines of travel of the driving terminal upon its supports, extending away from the driving terminal substantially parallel to its line of travel and over first sheaves with the opposite ends of each cable fastened to the biasing weight at substantially the same point, the length of each cable being such that the moments caused thereby in the driving terminal by the biasing weight linkage are equal when the driving terminal is not acted upon by other torquing force, and plural secondary sheaves supporting each cable between the first sheaves and the biasing weight to allow motion of each cable, responsive to vertical motion of the biasing weight, to bias the driving terminal to regulate tension in a driven traction cable.

* * * * *